US010612339B2

(12) United States Patent
Murphy

(10) Patent No.: US 10,612,339 B2
(45) Date of Patent: Apr. 7, 2020

(54) PACKING ELEMENT HAVING A BONDED PETAL ANTI-EXTRUSION DEVICE

(71) Applicant: Halliburton Energy Services, Inc., Houston, TX (US)

(72) Inventor: Thomas Murphy, Westhill (GB)

(73) Assignee: Halliburton Energy Services, Inc., Houston, TX (US)

( * ) Notice: Subject to any disclaimer, the term of this patent is extended or adjusted under 35 U.S.C. 154(b) by 111 days.

(21) Appl. No.: 15/756,981

(22) PCT Filed: Sep. 30, 2015

(86) PCT No.: PCT/US2015/053119
§ 371 (c)(1),
(2) Date: Mar. 1, 2018

(87) PCT Pub. No.: WO2017/058191
PCT Pub. Date: Apr. 6, 2017

(65) Prior Publication Data

US 2018/0252068 A1 Sep. 6, 2018

(51) Int. Cl.
*E21B 33/12* (2006.01)
*E21B 33/127* (2006.01)

(52) U.S. Cl.
CPC ..... *E21B 33/1216* (2013.01); *E21B 33/127* (2013.01)

(58) Field of Classification Search
CPC ..... E21B 19/46; E21B 19/20; E21B 33/1216; E21B 33/127
See application file for complete search history.

(56) References Cited

U.S. PATENT DOCUMENTS 2,738,013 A 3/1956 Lynes
6,167,963 B1 1/2001 McMahan et al.
6,827,150 B2 * 12/2004 Luke ..... E21B 33/1208 166/387
7,938,176 B2 * 5/2011 Patel ..... E21B 33/1216 166/187
8,403,036 B2 * 3/2013 Neer ..... E21B 33/128 166/118
8,408,316 B2 * 4/2013 Nutley ..... E21B 17/10 166/380
8,479,809 B2 * 7/2013 Farquhar ..... E21B 33/128 166/196
8,561,689 B2 * 10/2013 Nutley ..... E21B 33/1216 166/179

(Continued)

FOREIGN PATENT DOCUMENTS

WO 2014089150 A1 6/2014

OTHER PUBLICATIONS

International Search and Written Opinion dated Jul. 18, 2016 for PCT Application No. PCT/US2015/053119 filed on Sep. 30, 2015. 16 pages.

*Primary Examiner* — Nicole Coy
(74) *Attorney, Agent, or Firm* — Chamberlain Hrdlicka

(57) ABSTRACT

A packing system comprising an anti-extrusion plugging system is described. The system includes a plugging tool and an elastomeric packing element carried by the plugging tool. Both the tool and the packing element are independently coupled to different anti-extrusion assemblies that work together to prevent the elastomeric material from extruding.

15 Claims, 4 Drawing Sheets

(56) References Cited

U.S. PATENT DOCUMENTS

| | | | | |
|---|---|---|---|---|
| 8,584,764 | B2 * | 11/2013 | Nutley | E21B 17/10 166/380 |
| 9,896,900 | B2 * | 2/2018 | Clarke | E21B 33/128 |
| 10,016,918 | B2 * | 7/2018 | Rochen | B29C 45/14 |
| 2006/0232019 | A1 * | 10/2006 | Garrison | F16L 7/02 277/611 |
| 2010/0038074 | A1 | 2/2010 | Patal | |
| 2011/0101615 | A1 * | 5/2011 | Clarke | E21B 33/128 277/336 |
| 2011/0259610 | A1 * | 10/2011 | Shkurti | E21B 33/1204 166/386 |
| 2012/0217025 | A1 | 8/2012 | Shkurti et al. | |
| 2013/0277069 | A1 | 10/2013 | Nutley et al. | |
| 2014/0034335 | A1 | 2/2014 | Nutley et al. | |
| 2015/0226023 | A1 * | 8/2015 | Scruggs | E21B 47/12 166/250.1 |

* cited by examiner

PACKING ELEMENT HAVING A BONDED PETAL ANTI-EXTRUSION DEVICE

This disclosure relates to a packing system that is used in a subterranean well. More particularly, the disclosure relates to a packing system comprising a plugging tool and an elastomeric packing element that is used to seal a subterranean well or formation. Specifically, this disclosure relates to an elastomeric packing element that includes an anti-extrusion assembly.

BACKGROUND

Natural resources such as gas, oil, and water residing in a subterranean formation or zone are usually recovered by drilling a wellbore into the subterranean formation while circulating a drilling fluid in the wellbore. After terminating the circulation of the drilling fluid, a string of pipe (e.g., casing) is run in the wellbore. The drilling fluid is then usually circulated downward through the interior of the casing and upward through the annulus, which is located between the exterior of the pipe and the walls of the wellbore. Next, cementing is typically performed whereby a cement slurry is placed in the annulus and permitted to set into a hard mass (i.e., sheath) to thereby attach the casing to the walls of the wellbore and seal the annulus.

During the development and life of a hydrocarbon recovery well drilling, completing, servicing, and treating operations are routinely carried out. During these routine procedures, it is often necessary to seal one or more zones in the well from other zones, either temporarily or permanently. Often a packing system, having a plugging tool and a packing element will be used to create the desired zonal isolation.

A plugging tool is typically lowered into a cased oil or gas well and set at a desired location inside or outside the casing string to provide zonal isolation in the well. A packing element is carried by the plugging tool and is the structure to which physical force is applied so that a seal may be created. The packing element is caused to conform to the space between two adjacent zones in the wellbore and seal the well or formation. Retrievable plugs are used during drilling and workover operations to provide a temporary separation of zones. Permanent plugs are used to permanently close off the well, for example, above a lower zone or formation.

Commonly, when a lower zone has become non-productive but one or more upper zones remain productive, a through tubing bridge plug may be installed by lowering the bridge plug through the casing string on a conveyance such as a wireline, coiled tubing or the like and then setting the plug by axially compressing the packing elements of the bridge plug to expand them into contact with the inner surface of the casing to provide a seal. Once in the sealing configuration, a significant pressure differential can be created across the plug.

Likewise, during cementing or production, it may be desirable to seal one or more zones in the annular region of the wellbore between the casing string and the formation (wellbore wall). External casing packers may be deployed into the annular region between the casing string and the wellbore wall to seal one zone from an adjacent zone. The plug may again be set by axially compressing the packing elements of the packer to expand them into contact with the outer surface of the casing and the wellbore wall to provide a seal.

A variety of packing elements are known in the art and elastomeric packing elements have found favor because of their ability to conform and provide a dependable seal. Elastomeric packing elements may take different configurations, for example, they may be swell packers or pressure packers or inflatable packers or compression packers. Varied packer configurations allow selection of an appropriate packer material and expansion method that is suited to the wellbore to be sealed.

Generally, swell packers respond to hydraulic fluid pressure by expanding to fill the available space in the annulus or within the casing string. Swell packers are known to suffer from extrusion problems at high differential pressures which may result in seal loss. Accordingly, anti-extrusion devices have been developed to prevent extrusion of the elastomeric material at high differential pressures thereby minimizing seal loss. Prior anti-extrusion systems have included collar systems and petal assembly systems configured to hold the elastomeric packing material in place, see for example, U.S. Pat. No. 7,938,176. Such systems have proven to be either incapable of preventing extrusion or have been very complex causing issues relating to deployment or device reliability.

Prior anti-extrusion systems have used an expanding assembly to prevent extrusion. The assembly is generally equipped with a series of slots forming a series of petals that when protracted cover the end of the packing element. While these petal assemblies improve extrusion losses, they do not prevent them, as the slots used to form the petals leave gaps between the individual petals resulting in some elastomeric material extrusion. Overlapping petal assemblies have been described, e.g., a second expanding assembly of petals configured to overlap with a first set of petals and cover the gaps left by the first set of petals. Providing plugging tools with multiple expanding petal assemblies have heretofore required complex interlocking, multi-layer hinge mechanisms.

SUMMARY

To overcome one or more of these deficiencies, a system and method are described for preventing extrusion of an elastomeric packing element using multiple petal assemblies that is simple, cost effective and reliable. More particularly, a system is provided comprising a plugging tool and a packing element each of which carries an anti-extrusion assembly, e.g., a set of petals or a petal assembly. Locating tangs or other alignment structures can be carried on one of the anti-extrusion assemblies. When the plugging tool and packing element are aligned, the two sets of petals overlap and cover the gaps and prevent extrusion of the elastomeric material. Unlike the prior art interlinking petal plates that are complex, by providing the anti-extrusion assemblies on both the plugging tool and the packing element, the system need not interlink and can reply upon the simplicity associated with the deployment of a single anti-extrusion assembly (one petal assembly) and nonetheless achieve the benefits associated with the prior dual-assembly systems.

According to another embodiment, a method is provided for preventing extrusion of a packing material by aligning petals that are present on the plugging tool with petals present on the packing element without the need to interlink the two assemblies.

DESCRIPTION

Figure 1:
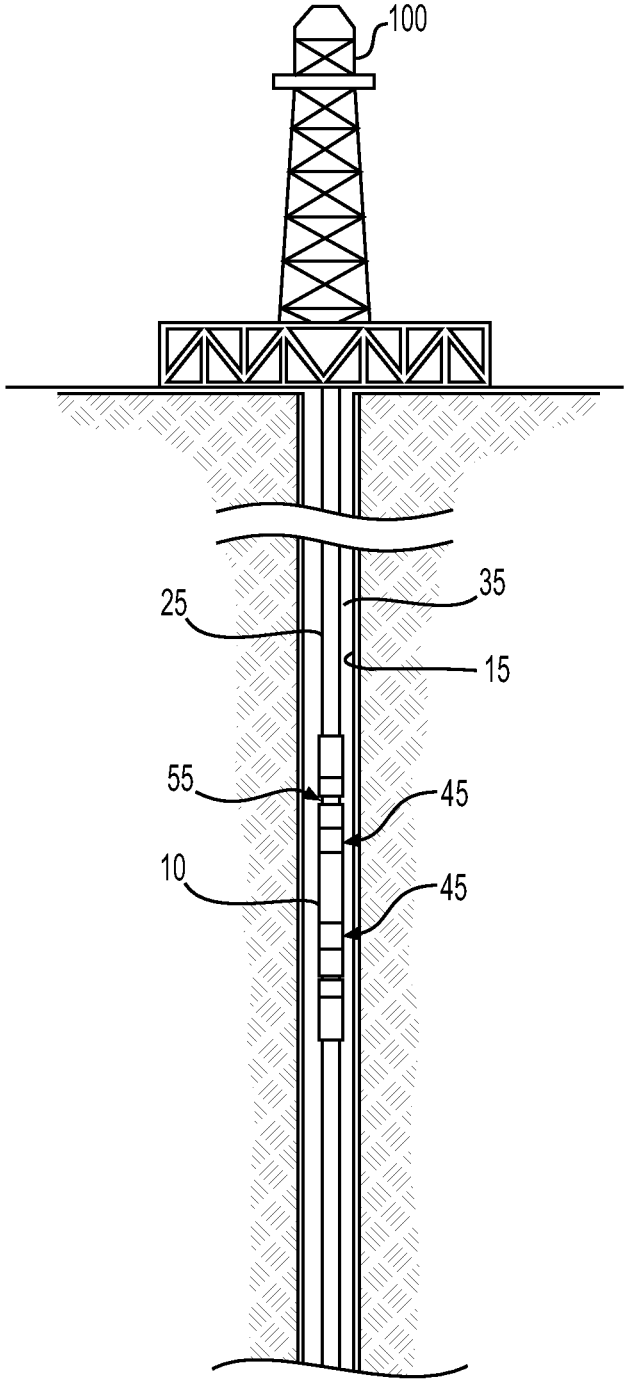
FIG. 1 illustrates one embodiment of an oil rig and wellbore.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same assembly or component by different names. This document does not intend to distinguish between components or features that differ in name but not structure or function.

In the following discussion and in the claims, the terms "including" and "comprising" are used in an open-ended fashion, and thus should be interpreted to mean "including, but not limited to . . . . The use of "top," "bottom," "above," "below," and variations of these terms is made for convenience, but does not require any particular orientation of the components.

Typical well operations use plugging tools and packing elements to segment a well and thereby isolate one zone or area from another zone or area. Such zonal isolation can be used, for example, during drilling operations, during cementing operations and during stimulation operations and is readily understood by the skilled artisan. In these operations, plugging may take place within the casing string, in the annulus surrounding the casing string or in an uncased wellbore. Such packing elements and plugging tools can be installed permanently downhole or can be retrievable.

According to one embodiment as described herein, when an elastomeric material is used as a packing element, it is preferable to include a mechanism to prevent extrusion of the elastomeric material outside of the area of deployment. When the elastomeric material is deformed, it can soften to a point where it can breach normal containment devices used in plugging tools.

FIG. 1 exemplifies an oil rig 100 and wellbore 15. According to the embodiment shown, the well comprises a borehole 15, a casing string 25 and a plugging tool 55. The plugging tool 55 and an associated packing element 10, surrounds the casing string 25. According to the embodiment shown, the packing element 10 can be expanded to fill the annulus 35 between the outside of the packing element and the wall of the wellbore 15 and thereby seal the upper portion of the wellbore 15 from a lower portion of the wellbore 15. The packing element 10 can be expanded by any suitable method. For example, the packing element 10 may be subjected to compression pressure from the tool 55 causing the element 10 to narrow and expand radially. Alternatively, the packing element 10 may be placed into contact with a hydrocarbon swelling fluid that when absorbed by the packing element 10, expands the size of the element 10 to fill and seal the annulus 35. Still further, the packing element 10 may be inflated using an appropriate liquid or gas medium.

According to the embodiment shown, the plugging tool 55 further comprises isolation elements 45 that can be used to assist in isolation during the deployment of the packing element 10. Isolation elements are elements that may be deployed more quickly than, for example, a swell packing element. These elements cannot withstand pressures as high as, for example, a swell packer; however, they can assist in disrupting the flow in the wellbore while the primary packer is deployed. If the packing element 10 is a swelling element that is activated by contact with an appropriate swelling fluid, the packing element 10 can take a number of hours or days to swell to its final state. The isolation elements 45 can assist in zone isolation during the swelling of the packing element 10.

According to another embodiment, the plugging tool 55 may be a production packer installed inside the casing string 25. More specifically, the plugging tool 55 may be a production packer that surrounds completion tubing and seals the area between the completion tubing and the inside wall of the casing string 25, see, for example, FIG. 4. According to yet another embodiment, the plugging tool 55 may be an interventional packer installed inside the completion tubing. More specifically, a plugging tool carries a retrievable packer into the completion tubing string to temporarily provide a seal between the oil reserve and the top of the well.

Any suitable plugging tool may be used to convey the described packing element 10 into the wellbore. For example, the plugging tool may be a bridge plug, a permanent or retrievable tension packer, a retrievable or permanent compression packer, a retrievable hydraulic-set packer a single string packer, a dual string packer, a production packer, a retrievable intervention packer or any other suitable packer configuration.

Figure 2:
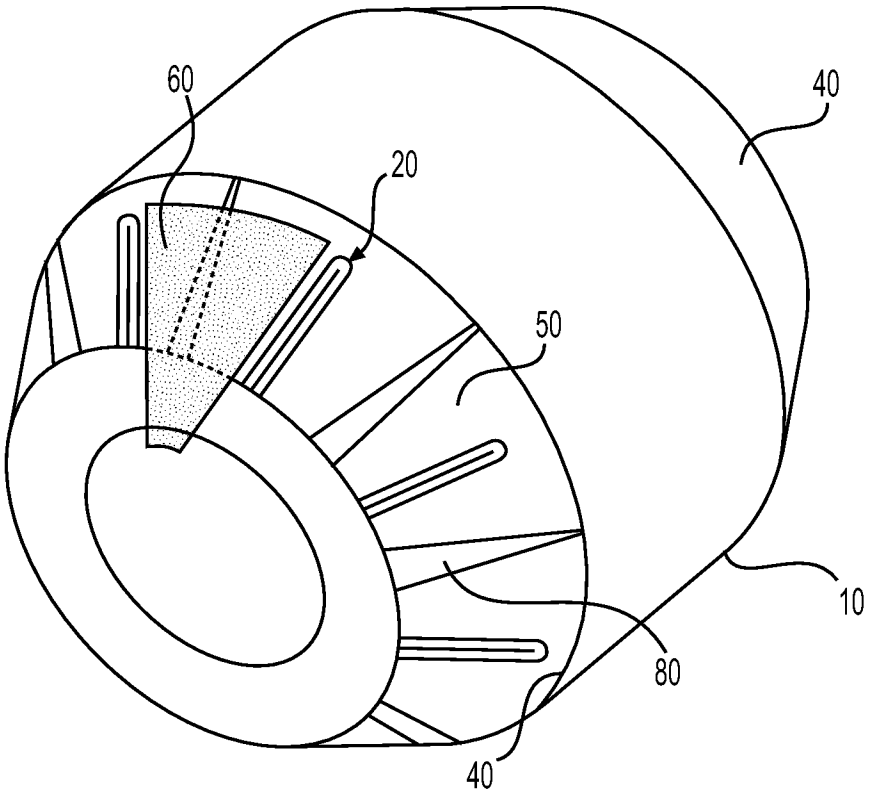
FIG. 2 a perspective view of the packing element including a bonded petal anti-extrusion assembly and a partial view of the petal assembly from the associated plugging tool.

According to one embodiment a packing element 10, as seen in FIG. 2, would be carried by the plugging tool into the wellbore 15 and would surround the casing string 25, for example, like an inner tube. The packing element 10 would expand and fill the space in the annulus 35. While the focus of the description has been on the use of the anti-extrusion assembly on one end of a packing element, the use of the same of a similar configuration on the other end of the packing element is fully contemplated by this disclosure.

Packing elements 10 as described herein may be made of any suitable material, including but not limited to elastomers, including for example, rubber and plastic materials. By way of example, elastomer materials that may be used in the production of the packing element include nitriles and hydrogenated nitriles, fluoroelastomers, for example, vinylidene fluorides, tetrafluoroethylenes, polytetrafluoroethylenes, perfluoroelastomers, or other suitable materials, for example, poly(p-phenylene sulfide). Selection of an appropriate elastomeric material for use in a particular wellbore will be based, in part, upon the downhole operating temperature and the materials to which the packing element will be exposed, including injected fluids, completion fluids and/or solvents.

According to one embodiment, the packing element 10 is a swell packer that swells upon the application of axial compression. According to another embodiment, the packing element 10 comprises a swelling-type elastomer material that swells in the presence of one or more of hydrocarbons, water, or an independent swelling fluid. When the elastomeric material contacts the swelling material or hydrocarbon or water, under appropriate temperatures and pressures, the elastomer will absorb the swelling fluid until the fluid and elastomer reach equilibrium. This swelling will cause the elastomeric packing element to expand and fill its surroundings. According to one embodiment, the packing element expands to fill the local void thereby sealing the wellbore. According to another embodiment, the packing element is first swelled and is then subject to compression pressure from the plugging tool to expand the elastomeric material radially to fill the void and seal the wellbore. According to yet another embodiment, the elastomeric packing elements may comprise a swelling polymer that expands in the presence of hydrocarbons, thereby not requiring the introduction of an independent swelling fluid or a mechanical activator.

According to one embodiment, the anti-extrusion petals 50 are individual segments that are coupled to the packing element 10. According to another embodiment, the anti-extrusion petals 50 may be part of an anti-extrusion assembly having gaps that extend inward from the outer edge of the assembly to define petals. As used herein "petal assembly" or "anti-extrusion assembly" refer to petals that are individually coupled to the packing element or plugging tool, as well as, petals that are indeed formed in a assembly or other anchoring structure that is coupled to the packing element or plugging tool. For ease of description, embodiments are described with respect to individual petals or petal assemblies. Such description is intended to cover the alternative embodiments unless noted otherwise.

While the anti-extrusion petals 50 will be discussed based upon a circular gapped assembly, the shape or length of the overall assembly or the shape or length of the petals can differ depending upon the cross-section of the packing element, plugging tool or cross-section one desires to seal. Any arrangement of petals can be used, provided the gaps (open areas, depending upon the petal configuration) in one anti-extrusion assembly can be covered by the petals in the other anti-extrusion assembly.

According to one embodiment, the petal assembly is configured to be in a retracted position before the packing element is swelled and in a protracted position after it has swelled. As used herein protracted and retracted refer to the position of the petals before, during and after deformation, e.g., swelling of the packing element. In the retracted position, the plugging tool 55 and packing element 10, have a narrowed circumference making it possible for the packer to move more easily through the wellbore 15 to reach the desired sealing position. According to one embodiment, the anti-extrusion assembly can be protracted by lifting petals from a position somewhere less than 90 degrees toward a 90 degree angle. The anti-extrusion assembly can be retracted by lowering the petals. According to yet another embodiment, the petals may be in a 90 degree or other sealing position and may be extended laterally, i.e., moved outward, to extend to a diameter necessary to seal the wellbore, the annulus or the casing string. The petal assembly can take any suitable shape including round or polygonal as would be appropriate for the associated packers. Suitable shapes will be well understood by the skilled artisan.

The anti-extrusion assembly can be produced from any suitable material that can withstand the pressures that are expected across the plug. For example, the anti-extrusion assembly may be formed from metals, ceramics or polymeric materials. The anti-extrusion system as described herein can be used with any suitable packing element that suffers from extrusion issues. According to another embodiment, the anti-extrusion assembly can be used to stabilize a packing element. According to this embodiment, even if the packing element does not appreciably extrude, the dual assembly structure may be used to stabilize an otherwise unstable packing element.

According to one embodiment, a plugging tool 55 and a packing element 10 are placed downhole and the packing element 10 is activated to cause the elastomeric material to expand and provide a seal in the wellbore 15. As the elastomeric material expands, the petals 50 on the anti-extrusion assembly on the packing element 10 are opened and nest with the petals 60 on the anti-extrusion assembly on the plugging tool. According to one embodiment, the anti-extrusion assembly on either the packing element or the plugging tool further comprises an alignment assembly 20. When the alignment assembly 20 is in position, the petals overlap at the gaps to restrict extrusion of the elastomeric material.

The alignment assembly may be chosen from a cooperative physical structure, a magnetic structure, an optical structure or any other suitable means for aligning the anti-extrusion assembly on the plugging tool with the anti-extrusion assembly on the packing element. According to one embodiment, the alignment assembly is a locating tang that is positioned, for example, at the center of the petals 50 or 60 as seen in FIG. 2. According to the embodiment shown, the positioning elements 20 on the petals 50 on the packing element 10 are spaced to accommodate the petals 60 on the plugging tool 55. Such an alignment assembly allows the two anti-extrusion assemblies to be properly positioned without having to be interconnected.

The packing element 10 as seen in FIG. 2, comprises two inclined segments 40 which carry the petals 50 in a retracted position. When protracted, the petals will engage and provide a seal between the packing element 10 and the interior or exterior of the casing string 25, the interior of a completion tube, or the wellbore wall 15. Attached to at least one end of the packing element 10 is a series of individual petals 50 or a assembly having petal oriented around the assembly. During use, the petals 50 move away from their retracted position against the outside of the packing element 10 and fill the inside diameter of the area to be sealed. The elastomeric material 10 expands to fill the space between the anti-extrusion petals 50 and the wall 15. Extrusion gaps 80 are formed between the petals 50 during such expansion. Locating tangs 20 are one method of mating the anti-extrusion assembly on the plugging tool 55 with the anti-extrusion petals on the packing element 10. As can be seen in FIG. 2, a representative petal 60 on the plugging tool would fit between two locating tangs 20 causing the petal on the plugging tool to cover the gap 80 left by the petals 50 on the packing element 10. As will be understood, the petal 60 is merely exemplary and is only one of a number of petals on the assembly affixed to the plugging tool.

Packing elements 10 may take any suitable shape including, but not limited to, a floppy cup wiper plug, a free fall plug, a five wiper plug, a high wiping efficiency (HWE) plug.

Figure 3:
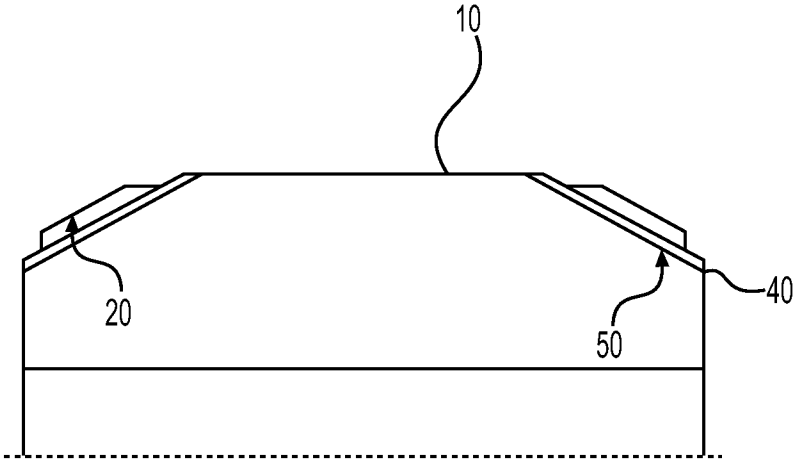
FIG. 3 is a cut away view of a packing element.

FIG. 3 is a cut-away view of the packing element 10 as seen in FIG. 2. The element 10 comprises an inclined segment 40 which carries petal elements 50 and positioning elements such as locating tangs 20. The positioning elements 20 properly mate the petals 60 on the associated plugging tool to the gaps 80 between the petals 50 on the packing element 10.

Figure 4:
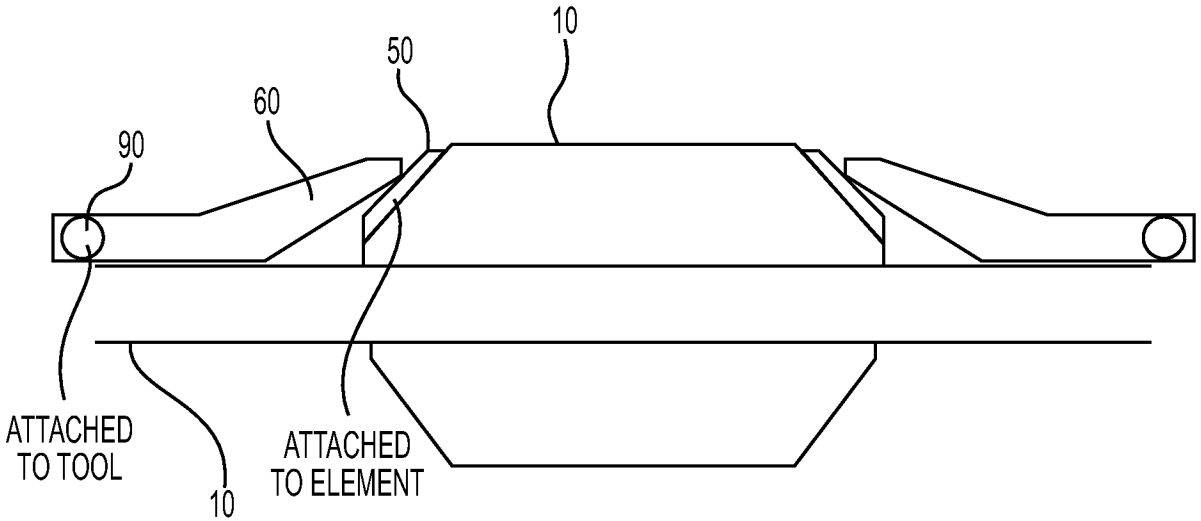
FIG. 4 is a cut away of a completion tubing and a packing element having anti-extrusion petals.

FIG. 4 illustrates the placement of the packing element on either the packer mandrel for an intervention packer or on the completion tubing for a production packer. The packing element 10 carries the petal element 50. As the packing element 10 swells, the petals 50 will expand outward toward the wall of the completion tubing for an intervention packer or toward the inside wall of the casing string 25 for a production packer. The intervention packer would seal the inside of the completion tubing, while the production packer will seal the annulus between the completion tubing and the inside of the casing string. According to this embodiment, the outward opening, or protracting, of petal 50 on the packing element 10 causes the petal 60, attached to the tool at a pivot point 90, to pivot and open outward toward the wall of completion tubing or casing string wall, depending upon the type of packer. The alignment of the petals 50 and 60 prevent extrusion of the elastomeric material from the gaps 80 between petals 50.

A packing system as described herein including an anti-extrusion assembly 50 on both the plugging tool 55 and the packing element 10 can be introduced to a wellbore 15 for the purpose of creating a seal. The packing element 10 may be used in any stage of the lifecycle of the well. The packing element 10 described herein may be used to create, for example, individual cementing zones or working zones. According to one embodiment, a plugging tool 55 is conveyed down a casing string 25 in the annulus 35 between the casing string 25 and the wellbore 15. When the plugging tool 55 reaches a sealing position, the packing element 10 is actuated by any suitable means as described above, such as being caused to swell or being subjected to a compressive force. The packing element 10, having an anti-extrusion assembly 50 thereon begins to protract. The anti-extrusion assembly on the plugging tool may be deployed before or after the packing element 10 expands. According to one embodiment, the expansion of the packing element 10 causes the anti-extrusion assembly 50 on the packing element 10 to expand and contact the anti-extrusion assembly on the plugging tool 55, thereby causing the anti-extrusion assembly on the plugging tool to also expand. Locating tangs 20 are carried by either the anti-extrusion assembly on either the packing element 10 or the plugging tool 55. The petals 50 or 60 of the anti-extrusion assemblies fit between the locating tangs 20 and thereby align the two anti-extrusion assemblies preventing extrusion of the elastomeric material. According to another embodiment, the anti-extrusion assemblies each carry locating tangs 20.

Although specific embodiments have been illustrated and described herein, it should be appreciated that any arrangement configured to achieve the same purpose may be substituted for the specific embodiments shown. This disclosure is intended to cover any and all adaptations or variations of various embodiments. Combinations of the above embodiments, and other embodiments not described herein, will be apparent to those of skill in the art upon reviewing the above description.

We claim:

1. A packing system for use in a wellbore comprising:

a plugging tool configured to carry a packing element;

at least one first anti-extrusion assembly having petals, wherein the at least one first anti-extrusion assembly is coupled to the plugging tool;

a packing element carried by the plugging tool and configured to expand radially to seal the wellbore;

at least one second anti-extrusion assembly having petals with gaps therebetween, wherein the second anti-extrusion assembly is coupled to the packing element;

wherein the at least one first anti-extrusion assembly and the at least one second anti-extrusion assembly are not directly coupled, but are aligned so that at least one of the petals on the at least one first anti-extrusion assembly extends over at least one gap in the at least one second anti-extrusion assembly; and wherein at least one of the first and second anti-extrusion assemblies further comprises an aligning structure comprising a physical structure comprising a locating tang to align the anti-extrusion assemblies.

2. The packing system of claim 1, wherein the packing element comprising an elastomeric material.

3. The packing system of claim 2, wherein the elastomeric packing element comprises at least one of rubber, plastic, nitriles, hydrogenated nitriles, fluoroelastomers, and poly(p-phenylene sulfide).

4. The packing system of claim 3, wherein the fluoroelastomers are chosen from at least one of vinylidene fluorides, tetrafluoroethylenes, polytetrafluoroethylenes, and perfluoroelastomers.

5. The packing system of claim 1, wherein the at least one first and the at least one second anti-extrusion assemblies are configured to be both protracted and retracted.

6. The packing system of claim 1, wherein the petals on one of the at least one first or second anti-extrusion assembly petals abut the locating tang to align the least one of the petals on the first anti-extrusion assembly extends over at least one gap in the second anti-extrusion assembly.

7. The packing system of claim 1, wherein the plugging tool is chosen from a bridge plug, a permanent or retrievable tension packer, a retrievable or permanent compression packer, a retrievable hydraulic-set packer, a single string packer, or a dual string packer.

8. The packing system of claim 1, wherein the second anti-extrusion assembly is coupled to the packing element by adhesive bonding.

9. A method for limiting the vertical expansion of a packing element while sealing an annulus in a hydrocarbon wellbore, the method comprising:

providing a plugging tool coupled to at least one first anti-extrusion assembly having gaps and petals;

providing an elastomeric packing element coupled to at least one second anti-extrusion assembly having gaps and petals;

aligning the at least one first anti-extrusion assembly and the at least one second anti-extrusion assembly so that at least one of the petals on the at least one first anti-extrusion assembly extends over at least one gap in the at least one second anti-extrusion assembly without interlocking by rotating either the element or the tool until at least one petal abuts a locating tang;

deploying the plugging tool into the wellbore; and deforming the elastomeric packing element to provide a seal in the annulus.

10. The method of claim 9, wherein the elastomeric packing element is deformed by subjecting the packing element to pressure, by placing the packing element into contact with a hydrocarbon swelling fluid to expand the element or, by inflating the packing element using an appropriate liquid or gas medium.

11. The method of claim 9, wherein the elastomeric packing element comprises at least one of rubber, plastic, nitriles, hydrogenated nitriles, fluoroelastomers, and poly(p-phenylene sulfide).

12. The method of claim 9, wherein the petals of the at least one first and at least one second anti-extrusion assemblies are protracted during the deforming step to extend to the wall of the wellbore.

13. The method of claim 9, wherein the petals of the at least one first and at least one second anti-extrusion assemblies are in a retracted position prior to deformation.

14. The method of claim 9, wherein the second anti-extrusion assembly is coupled to the packing element by adhesive bonding.

15. The method of claim 9, wherein the elastomeric packing element is deformed by bringing the element into contact with a swelling fluid.

* * * * *